US006945141B2

(12) United States Patent
Hu

(10) Patent No.: US 6,945,141 B2
(45) Date of Patent: Sep. 20, 2005

(54) REVERSIBLE RATCHET TYPE WRENCH

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 83 days.

(21) Appl. No.: 10/131,105

(22) Filed: Apr. 22, 2002

(65) Prior Publication Data

US 2003/0196522 A1 Oct. 23, 2003

(51) Int. Cl.[7] ..... B25B 13/46
(52) U.S. Cl. ..... 81/63.2; 81/63
(58) Field of Search ..... 81/63.2, 60, 61, 81/62, 63.1

(56) References Cited

U.S. PATENT DOCUMENTS

| | | | | |
|---|---|---|---|---|
| 15,482 | A | 8/1856 | Gilman | 81/63 |
| 726,012 | A | 4/1903 | Andrew | |
| 810,599 | A | 1/1906 | Ansorge | |
| 841,686 | A | 1/1907 | Hatfield | |
| 878,657 | A | 2/1908 | Munch | |
| 893,097 | A | 7/1908 | Reams | |
| 915,446 | A | 3/1909 | Kearnes | |
| RE13,205 | E | 2/1911 | Lane | |
| 1,033,358 | A | 7/1912 | Turner | |
| 1,078,059 | A | 11/1913 | Mossberg | |
| 1,090,578 | A | 3/1914 | Smythe | |
| 1,194,471 | A | 8/1916 | Boosinger | |
| 1,261,092 | A | 4/1918 | Allen | |
| 1,382,492 | A | 6/1921 | Evans | 81/63 |
| 1,426,127 | A | 8/1922 | Tuttle | |
| 1,614,039 | A | 1/1927 | Mandl | |
| 1,639,078 | A | 8/1927 | Coe | |
| 1,680,515 | A | 8/1928 | Gormley | |
| 1,957,462 | A | 5/1934 | Kress | 81/63 |
| 2,193,984 | A | 3/1940 | Rhinevault | |
| 2,201,705 | A | 5/1940 | Stone | |
| 2,201,827 | A | 5/1940 | Froeschl et al. | |
| 2,317,461 | A | 4/1943 | Jackson | |
| 2,542,241 | A | 2/1951 | Fors | |
| 2,657,604 | A | 11/1953 | Rueb | 81/63.2 |
| 2,701,977 | A | 2/1955 | Stone | |
| 2,735,324 | A | 2/1956 | Goldwater et al. | 81/60 |
| 2,764,048 | A | 9/1956 | Thompson | |

(Continued)

FOREIGN PATENT DOCUMENTS

| | | |
|---|---|---|
| DE | 373436 | 4/1923 |
| DE | 921198 | 7/1949 |
| DE | 1810811 | 6/1970 |
| DE | 29907467 | 9/1999 |
| DE | 29910932 | 9/1999 |
| FR | 498276 | 1/1920 |
| GB | 1559093 | 1/1980 |
| GB | 2135226 | 8/1984 |

OTHER PUBLICATIONS

EPO Search Report for Appln. No. EP 00 12 6902 dated Feb. 17, 2003 (3p.) 0570.
Appeal Brief against Office Action on Opposition to Patent Application No. 089200570 P01 in Taiwan and translation of same.
First Office Action on Patent Application No. 001003289 in People's Republic of China and Translation.

(Continued)

*Primary Examiner*—M. Rachuba
(74) *Attorney, Agent, or Firm*—Alan D. Kamrath Nikolai & Mersereau, P.A.

(57) ABSTRACT

A reversible ratchet type wrench includes a handle and a box end extending from an end of the handle and having a hole. A compartment is defined in a peripheral wall defining the hole of the box end and communicated with the hole. A receiving hole extends from a side of the box end toward the other side of the box end but spaced from the other side of the box end. The receiving hole intersects the compartment. A bulge portion is formed in a conjunctive area between the handle and the box end. A slot is defined in the bulge portion and communicated with the receiving hole.

20 Claims, 18 Drawing Sheets

U.S. PATENT DOCUMENTS

| | | | | |
|---|---|---|---|---|
| 2,769,360 | A | 11/1956 | Cottrell et al. | |
| 2,800,821 | A | 7/1957 | Fruscella | |
| 2,803,980 | A | 8/1957 | Vogel | 81/62 |
| 2,891,434 | A | 6/1959 | Lozensky | |
| 2,957,377 | A | 10/1960 | Hare | |
| 2,976,081 | A | 4/1961 | Lundin | |
| 3,019,682 | A | 2/1962 | Hare | 81/63.2 |
| 3,044,591 | A | 7/1962 | Kilness | |
| 3,233,481 | A | 2/1966 | Bacon | |
| 3,250,157 | A | 5/1966 | Badger | |
| 3,265,171 | A | 8/1966 | Kilness | 81/63 |
| 3,269,496 | A | 8/1966 | Kilness | |
| 3,337,014 | A | 8/1967 | Sandrick | 81/63 |
| 3,342,229 | A | 9/1967 | Janes | |
| 3,393,587 | A | 7/1968 | Jolliff et al. | |
| 3,393,780 | A | 7/1968 | Kilness | 81/63 |
| 3,436,992 | A | 4/1969 | Over et al. | |
| 3,577,816 | A | 5/1971 | Alexander et al. | |
| 3,598,001 | A | 8/1971 | Thomasian | 81/63.1 |
| 3,606,940 | A | 9/1971 | Finkeldei | |
| 3,713,356 | A | 1/1973 | Knudsen | |
| 3,742,788 | A | 7/1973 | Priest | |
| 3,783,703 | A | 1/1974 | Trimble et al. | |
| 3,838,614 | A | 10/1974 | O'Donnell | |
| 3,866,492 | A | 2/1975 | Knoll | |
| 3,908,487 | A | 9/1975 | Plaw | |
| 3,970,155 | A | 7/1976 | Otto | |
| 4,053,037 | A | 10/1977 | Solomon | |
| 4,070,932 | A | 1/1978 | Jeannotte | |
| 4,111,077 | A | 9/1978 | Cummings et al. | |
| 4,128,025 | A | 12/1978 | Main et al. | 81/63 |
| 4,147,076 | A | 4/1979 | Wright et al. | |
| 4,257,507 | A | 3/1981 | Solomon | |
| 4,274,311 | A | 6/1981 | Ebert | |
| 4,277,989 | A | 7/1981 | Tracy | |
| 4,277,990 | A | 7/1981 | Hall | |
| 4,308,768 | A | 1/1982 | Wagner | |
| 4,308,769 | A | 1/1982 | Rantanen | |
| 4,328,720 | A | 5/1982 | Shiel | |
| 4,336,728 | A | 6/1982 | Deibert | |
| 4,406,186 | A | 9/1983 | Gummow | |
| 4,420,995 | A | 12/1983 | Roberts | |
| 4,485,700 | A | 12/1984 | Colvin | |
| 4,488,460 | A | 12/1984 | Ballone et al. | |
| 4,512,218 | A | 4/1985 | Chow | |
| 4,520,697 | A | 6/1985 | Moetteli | |
| 4,631,988 | A | 12/1986 | Colvin | |
| 4,662,251 | A | 5/1987 | Kohal | |
| 4,709,600 | A | 12/1987 | Mierbach et al. | |
| 4,722,252 | A | 2/1988 | Fulcher et al. | |
| 4,722,253 | A | 2/1988 | Chow | |
| 4,762,033 | A | 8/1988 | Chow | |
| 4,770,072 | A | 9/1988 | Neuhaus | 81/63.2 |
| 4,777,852 | A | 10/1988 | Herman et al. | |
| 4,796,492 | A | 1/1989 | Liou | 81/58.4 |
| 4,807,500 | A | 2/1989 | Main | |
| 4,862,775 | A | 9/1989 | Chow | |
| 4,869,138 | A | 9/1989 | Farris | |
| 4,903,554 | A | 2/1990 | Colvin | |
| 4,924,737 | A | 5/1990 | Gummow | |
| 4,934,220 | A | 6/1990 | Slusar et al. | |
| 4,986,147 | A | 1/1991 | Cooper | |
| 4,991,468 | A | 2/1991 | Lee | |
| 5,000,066 | A | 3/1991 | Gentiluomo | 81/62 |
| 5,012,705 | A | 5/1991 | Chow | |
| 5,038,452 | A | 8/1991 | Beugelsdyk et al. | 29/436 |
| 5,076,121 | A | 12/1991 | Fosella | 81/58.4 |
| 5,144,869 | A | 9/1992 | Chow | |
| 5,157,994 | A | 10/1992 | Krivec | 81/63.2 |
| 5,178,047 | A | 1/1993 | Arnold et al. | 81/63.2 |
| 5,199,330 | A | 4/1993 | Arnold et al. | |
| 5,199,335 | A | 4/1993 | Arnold et al. | |
| 5,230,262 | A | 7/1993 | Ahlund et al. | 81/63.2 |
| 5,231,903 | A | 8/1993 | Bockman, Jr. | |
| 5,233,891 | A | 8/1993 | Arnold et al. | 81/63.2 |
| 5,271,300 | A | 12/1993 | Zurbuchen et al. | |
| 5,295,422 | A | 3/1994 | Chow | |
| 5,347,892 | A | 9/1994 | Moetteli | |
| 5,392,672 | A | 2/1995 | Larson et al. | |
| 5,404,773 | A | 4/1995 | Norville | |
| 5,425,291 | A | 6/1995 | Chang | 81/60 |
| 5,448,931 | A | 9/1995 | Fossella et al. | 81/63.2 |
| 5,467,672 | A | 11/1995 | Ashby | |
| 5,477,757 | A | 12/1995 | Maresh | |
| 5,495,783 | A | 3/1996 | Slusar et al. | |
| 5,499,560 | A | 3/1996 | Aeschliman | |
| 5,501,124 | A | 3/1996 | Ashby | |
| 5,509,333 | A | 4/1996 | Rion | |
| 5,522,288 | A * | 6/1996 | Slusar et al. | 81/63 |
| 5,533,427 | A | 7/1996 | Chow | 81/63.2 |
| 5,535,646 | A | 7/1996 | Allen et al. | |
| 5,557,994 | A | 9/1996 | Nakayama | |
| 5,582,081 | A | 12/1996 | Lin | |
| 5,584,220 | A | 12/1996 | Darrah et al. | |
| 5,595,095 | A | 1/1997 | Hillinger | |
| 5,622,089 | A | 4/1997 | Gifford, Sr. | 81/62 |
| 5,626,061 | A | 5/1997 | Whitley | |
| 5,626,062 | A | 5/1997 | Colvin | 81/63.2 |
| 5,636,557 | A | 6/1997 | Ma | |
| 5,669,875 | A | 9/1997 | van Eerdenburg | |
| 5,709,137 | A | 1/1998 | Blacklock | |
| 5,749,272 | A | 5/1998 | Phan | 81/62 |
| 5,782,147 | A | 7/1998 | Chaconas et al. | |
| 5,794,496 | A | 8/1998 | Arnold | 81/63.2 |
| 5,829,326 | A | 11/1998 | Richner | |
| 5,842,391 | A | 12/1998 | Chaconas | 81/62 |
| 5,857,390 | A | 1/1999 | Whiteford | 81/62 |
| 5,873,286 | A | 2/1999 | Van Lenten | |
| 5,878,635 | A | 3/1999 | Hsieh | 81/63 |
| 5,884,537 | A | 3/1999 | Chen | |
| 5,884,538 | A | 3/1999 | Van Lenten | |
| 5,887,493 | A | 3/1999 | Main | |
| 5,901,620 | A | 5/1999 | Arnold | 81/63 |
| 5,910,197 | A | 6/1999 | Chaconas | |
| 5,911,798 | A | 6/1999 | Arnold | |
| 5,913,954 | A | 6/1999 | Arnold et al. | |
| 5,927,158 | A | 7/1999 | Lin | |
| 5,946,987 | A | 9/1999 | Wei | |
| 5,946,989 | A | 9/1999 | Hsieh | |
| 5,957,009 | A | 9/1999 | McCann | 81/63.2 |
| 5,964,129 | A | 10/1999 | Shiao | |
| 5,970,552 | A | 10/1999 | Kwiecien et al. | |
| 5,979,274 | A | 11/1999 | Hsieh | |
| 5,996,453 | A | 12/1999 | Blacklock | |
| 6,000,302 | A | 12/1999 | Chiang | |
| 6,006,631 | A | 12/1999 | Miner et al. | |
| 6,044,731 | A | 4/2000 | Hsieh | |
| 6,065,374 | A | 5/2000 | Taggart | 81/63.2 |
| 6,125,722 | A | 10/2000 | Hopper, Jr. et al. | |
| 6,134,990 | A | 10/2000 | Ling et al. | |
| 6,134,991 | A | 10/2000 | Chaconas | |
| D433,896 | S | 11/2000 | Wei | |
| D434,292 | S | 11/2000 | Hsieh | D8/28 |
| 6,148,695 | A | 11/2000 | Hu | |
| 6,152,826 | A | 11/2000 | Profeta et al. | |
| 6,155,140 | A | 12/2000 | Tsai | |
| 6,161,454 | A | 12/2000 | Chaconas | |
| 6,164,167 | A * | 12/2000 | Chen | 81/63.2 |
| 6,205,889 | B1 | 3/2001 | Hsieh | |
| 6,209,423 | B1 | 4/2001 | Shiao | 81/60 |
| 6,216,563 | B1 | 4/2001 | Hsieh | |

| | | | | |
|---|---|---|---|---|
| 6,216,567 | B1 | 4/2001 | Hu | |
| 6,220,123 | B1 | 4/2001 | Chen | |
| 6,230,591 | B1 | 5/2001 | Ling et al. | |
| 6,240,813 | B1 | 6/2001 | Hyatt | |
| 6,257,096 | B1 | 7/2001 | Ling | 81/60 |
| 6,257,097 | B1 | 7/2001 | I-He | |
| 6,260,448 | B1 | 7/2001 | Chaconas | |
| 6,260,449 | B1 | 7/2001 | I-He | |
| 6,263,767 | B1 | 7/2001 | Hu | |
| 6,282,991 | B1 | 9/2001 | Hu | |
| 6,282,992 | B1 | 9/2001 | Hu | |
| 6,282,993 | B1 | 9/2001 | Forman et al. | |
| 6,301,998 | B1 | 10/2001 | Hu | |
| 6,308,594 | B1 | 10/2001 | Cheng | 81/62 |
| 6,334,373 | B1 | 1/2002 | Hsieh | 81/60 |
| 6,382,051 | B1 | 5/2002 | Chang | 81/60 |
| 6,382,052 | B1 | 5/2002 | Chen | 81/63 |
| 6,386,072 | B1 | 5/2002 | Yuan-Chin et al. | 81/63.2 |
| 6,431,031 | B1 | 8/2002 | Hu | |
| 6,435,062 | B1 | 8/2002 | McCann | 81/63 |
| 6,435,063 | B1 | 8/2002 | Chen | 81/63.2 |
| 6,450,066 | B1 | 9/2002 | Hu | |
| 6,450,068 | B1 | 9/2002 | Hu | |
| 6,453,779 | B2 | 9/2002 | Hu | |
| 6,457,387 | B1 | 10/2002 | Hu | |
| 6,457,388 | B1 | 10/2002 | Chen | 81/63.2 |
| 6,457,389 | B1 | 10/2002 | Hu | |
| 6,488,136 | B2 | 12/2002 | Chang | |
| 6,516,691 | B1 | 2/2003 | Wei | 81/63.2 |
| 6,520,051 | B1 | 2/2003 | Hu | |
| 6,539,825 | B1 | 4/2003 | Lin | 81/60 |
| 6,568,299 | B2 | 5/2003 | Hu | 81/63.2 |
| 6,591,717 | B2 | 7/2003 | Wei | 81/60 |
| 6,629,477 | B2 | 10/2003 | Ling et al. | 81/63.2 |
| 6,644,148 | B2 | 11/2003 | Hu | 81/63.2 |
| 6,647,832 | B2 | 11/2003 | Hu | 81/63.2 |
| 6,662,693 | B2 | 12/2003 | Hu | |
| 6,666,112 | B2 | 12/2003 | Hu | 81/63.2 |
| 6,666,117 | B2 | 12/2003 | Hu | 81/467 |
| 6,722,234 | B2 | 4/2004 | Hu | 81/63.2 |
| 6,732,614 | B2 | 5/2004 | Hu | 81/63.2 |
| 6,745,647 | B2 | 6/2004 | Wang | |
| 6,748,825 | B2 | 6/2004 | Hsu | 81/60 |
| 6,758,641 | B2 | 7/2004 | Hu | 409/132 |
| 2001/0035074 | A1 | 11/2001 | Hu | |
| 2002/0017169 | A1 | 2/2002 | Hu | |
| 2002/0023519 | A1 | 2/2002 | Hu | |
| 2002/0023520 | A1 | 2/2002 | Hu | |
| 2002/0026858 | A1 | 3/2002 | Hu | |
| 2002/0062718 | A1 | 5/2002 | Wang | |
| 2002/0088312 | A1 | 7/2002 | Ling et al. | 81/63.2 |
| 2002/0112573 | A1 | 8/2002 | Hu | 81/63.2 |
| 2002/0162423 | A1 | 11/2002 | Hu | |
| 2002/0162424 | A1 | 11/2002 | Hu | |
| 2002/0166416 | A1 | 11/2002 | Hu | |
| 2002/0166417 | A1 | 11/2002 | Hu | |
| 2002/0194950 | A1 | 12/2002 | Hu | |
| 2003/0010159 | A1 | 1/2003 | Hu | |
| 2003/0010163 | A1 | 1/2003 | Hu | |
| 2003/0012614 | A1 | 1/2003 | Hu | |
| 2003/0019335 | A1 | 1/2003 | Hu | |
| 2003/0070512 | A1 | 4/2003 | Hu | 81/63.2 |
| 2004/0093995 | A1 | 5/2004 | Hu | 81/63.2 |

OTHER PUBLICATIONS

Office Action by Taiwan Intellectual Property Office on Opposition to Patent Application No. 089200570 in Taiwan and Translation; and Translations of Taiwanese Patent Publication No. 212343, of Taiwanese Patent Publication No. 310649, and of Taiwanese Patent Publication No. 130638.

Decision by the Board of Appeal and Translation of same.

Taiwan Intellectual Property Office's Answer to Appeal Brief and Translation of same.

Complaint for Declatory Judgement of Noninfringement, Unenforceability, and Invalidity of a Patent, dated Sep. 26, 2002.

Amended Complaint for Declatory Judgement of Noninfringement, Unenforceability, and Invalidity of a Patent, dated Sep. 19, 2003.

Plaintiff's Second Supplemental Response to Interrogatory No. 3 of Defendant's First Set of Interrogatories, dated Apr. 21, 2004.

Tool and manufacturing Engineers Handbook, 1976, 3rd Edition, pp. 6–48.

* cited by examiner

REVERSIBLE RATCHET TYPE WRENCH

BACKGROUND OF THE INVENTION

1. Field of the Invention

The present invention relates to a reversible ratchet type wrench of the type having a bulged portion in a box end thereof, wherein a slot is defined in the bulge portion for installation of a switch member for switching ratcheting directions of the wrench.

2. Description of the Related Art

FIG. 16 of the drawings is an exploded perspective view of a conventional reversible ratchet type wrench comprising a handle 3 and a box end 2 extending from the handle 3. FIG. 17 is a sectional view of the reversible ratchet type wrench. A bulge portion 4 is formed in a conjunctive area between the handle 3 and the box end 2. A gear wheel 1 is rotatably mounted in a hole 7 defined in the box end 2. A compartment 6 is defined in a peripheral wall defining the box end 2 for receiving a pawl 9. A receptacle 94 is defined in a wall defining the compartment 6 and facing the hole 7. A spring 92 and a ball 93 are mounted in the receptacle 94 for biasing the pawl 9 to engage with the gear wheel 1. A slot 5 is defined in the bulge portion 4 and communicated with the compartment 6. A switch member 8 includes a first end with a protrusion 82 for engaging with a notch or groove 91 in an upper side of the pawl 9. The switch member 8 further includes a second end 81 extending outside of the compartment 6 through the slot 5 for manual operation. Thus, the user may switch the second end 81 of the switch member 91 between two positions corresponding to two ratcheting directions of the wrench. However, oil, dirt, ashes, or larger alien objects may enter the compartment 6 through the slot 5 such that the wrench could not be used after the pawl 9 has stuck. Further, the switch member 8 would move together with the pawl 9 during operation of the wrench. The engagement between the pawl 9 and the gear wheel 1 is adversely affected if the second end 81 of the switch member 8 is inadvertently impinged by the user's finger or an alien object. As a result, the torque of the wrench is adversely affected.

SUMMARY OF THE INVENTION

An objective of the present invention is to provide a reversible ratchet type wrench that prevents entrance of alien objects into an interior of the wrench and that provides reliable engagement between the drive member (e.g., a gear wheel) and the pawl.

In accordance with a first aspect of the invention, there is provided a reversible ratchet type wrench comprising:

a handle;

a box end extending from an end of the handle and having a first side and a second side opposite to the first side, a hole being defined in the box end, a compartment being defined in a peripheral wall defining the hole of the box end and communicated with the hole, a receiving hole extending from the first side of the box end toward the second side of the box end but spaced from the second side of the box end, the receiving hole intersecting the compartment;

a bulge portion formed in a conjunctive area between the handle and the box end, a slot being defined in the bulge portion and communicated with the receiving hole;

a drive member rotatably mounted in the hole of the box end and including a plurality of teeth on an outer periphery thereof;

a pawl slidably mounted in the compartment of the box end and including a toothed side;

a pivotal member rotatably mounted in the receiving hole of the box end;

a switch member extending through the slot of the bulge portion, the switch member including a first end securely engaged with the pivotal member to move therewith and a second end outside the box end for manual operation between two positions corresponding to two ratcheting directions of the wrench;

a pressing member mounted between the pawl and the pivotal member; and an elastic element for biasing the pressing member against the pawl.

Oil, dirt, ashes, or larger alien objects could not enter the compartment through the slot, as they will be obstructed by the pivotal member in the compartment. Formation of the slot is easy. Further, the switch member would not move together with the pawl during operation of the wrench. The engagement between the pawl and the drive member is not adversely affected.

In accordance with a second aspect of the invention, there is provided a reversible ratchet type wrench handle comprising:

a box end extending from an end of the handle and having a first side and a second side opposite to the first side, a hole being defined in the box end, a compartment being defined in a peripheral wall defining the hole of the box end and communicated with the hole, a receiving hole extending from the first side of the box end toward the second side of the box end but spaced from the second side of the box end, the receiving hole intersecting the compartment; and a bulge portion formed in a conjunctive area between the handle and the box end, a slot being defined in the bulge portion and communicated with the receiving hole.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
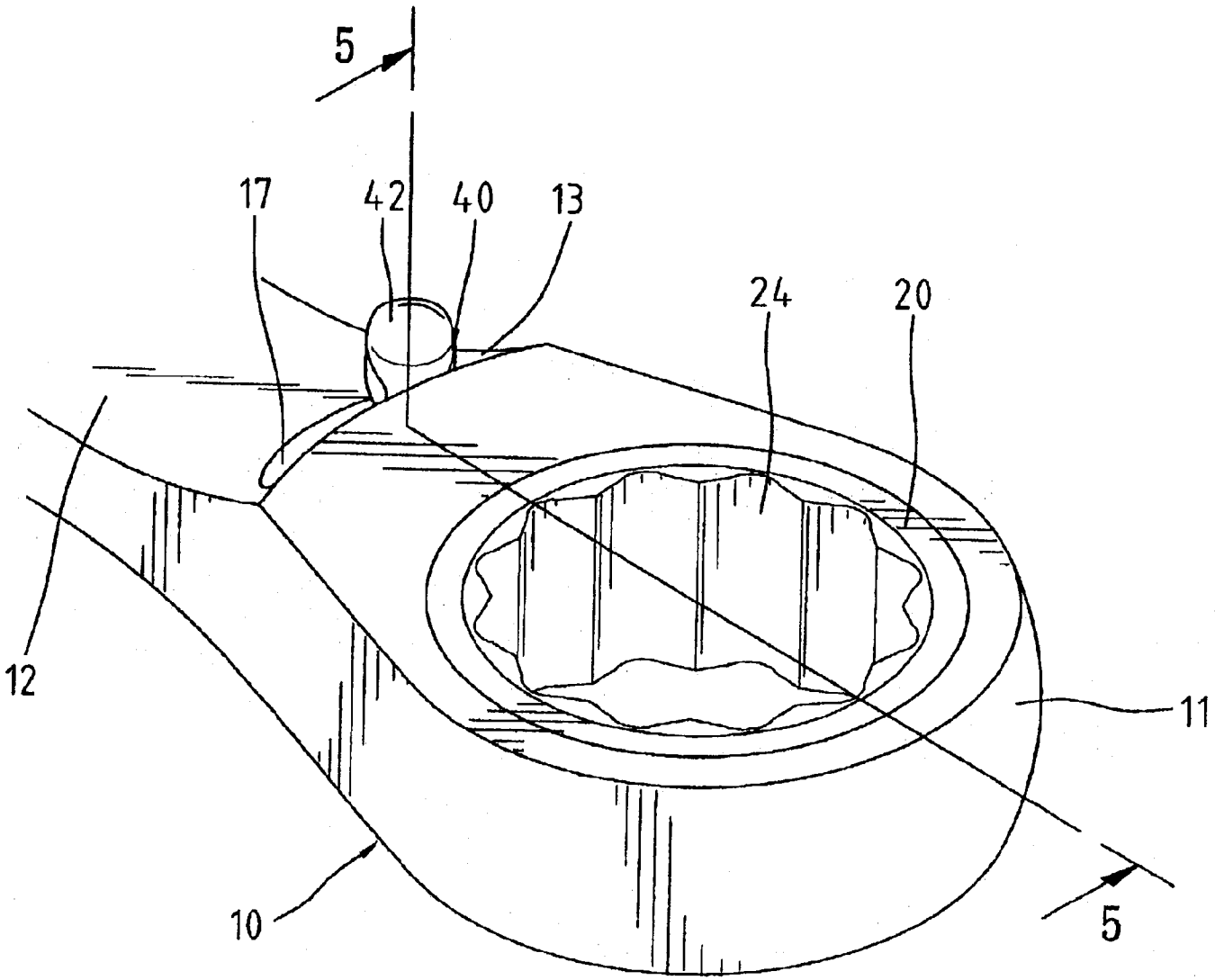
FIG. 1 is a perspective view of a first embodiment of a reversible ratchet type wrench in accordance with the present invention.
Figure 2:
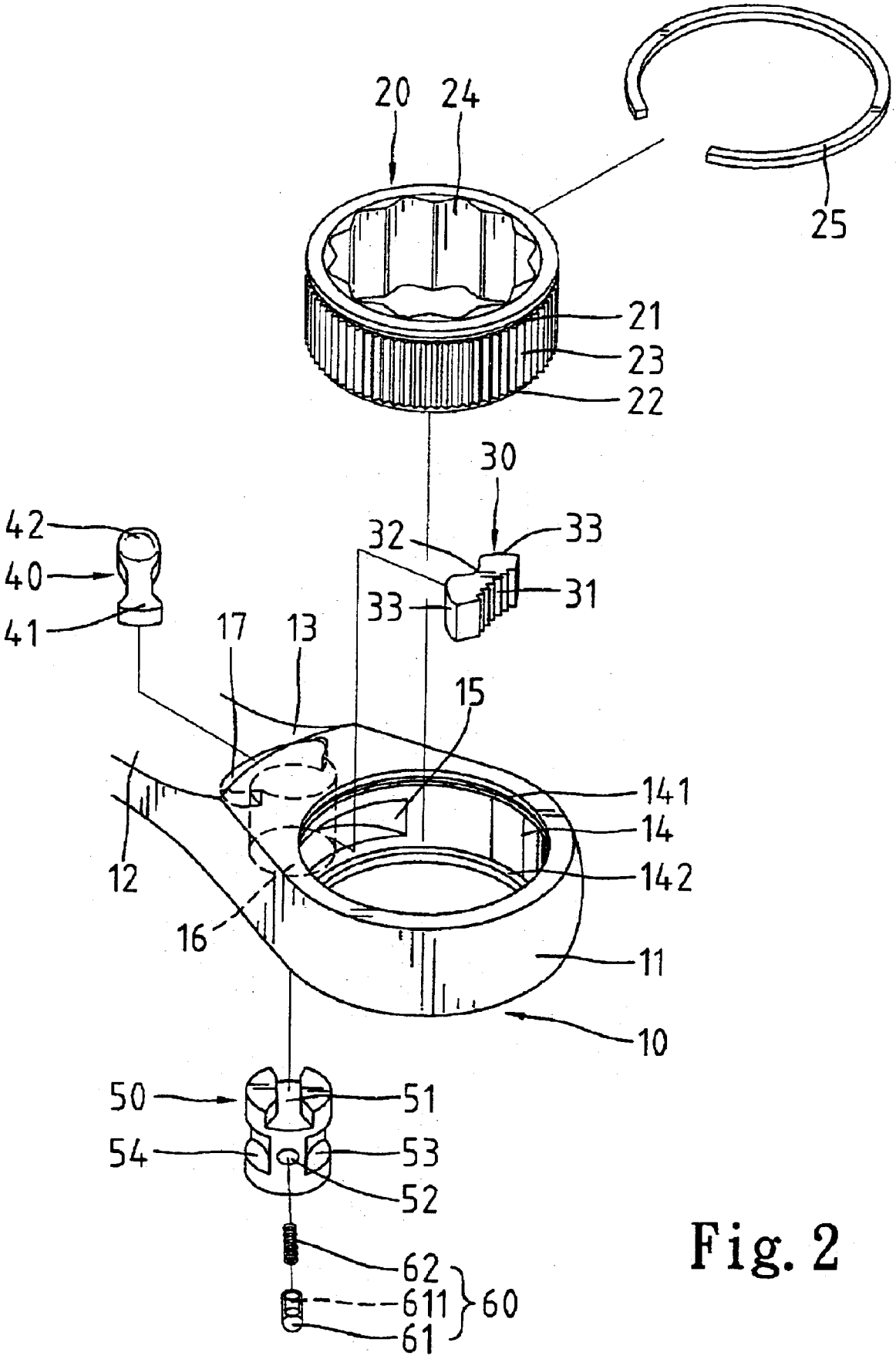
FIG. 2 is an exploded perspective view of the reversible ratchet type wrench in FIG. 1.
Figure 5:
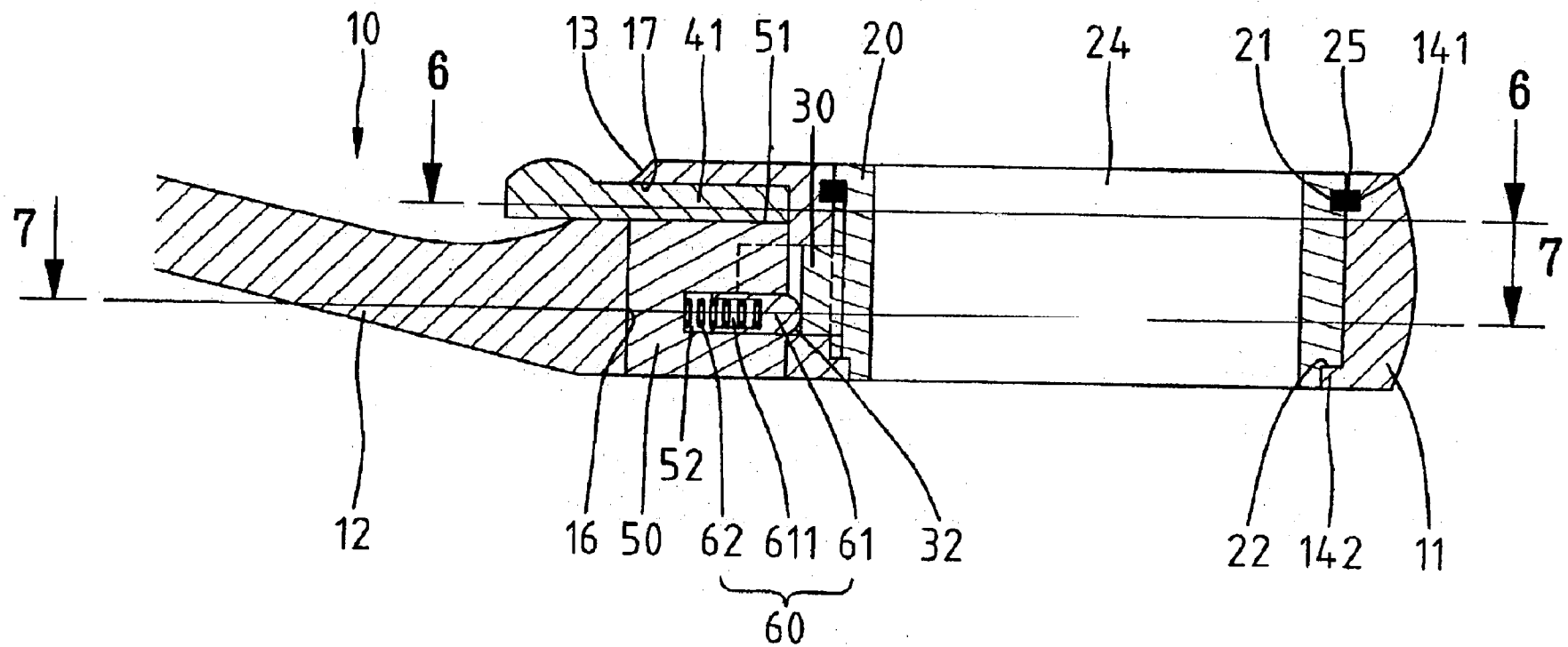
FIG. 5 is a sectional view taken along plane 5—5 in FIG. 1.

Referring to FIGS. 1, 2, and 5, a first embodiment of a reversible ratchet type wrench in accordance with the present invention is designated by "10" and generally comprises a handle 12 having a box end 11 extending from an end of the handle 12. A bulge portion 13 is formed in a conjunctive area between the handle 12 and the box end 11. An annular groove 141 is defined in an end of a peripheral wall defining a hole 14 in the box end 11, and an annular ledge 142 is formed on the other end of the peripheral wall defining the hole 14 of the box end 11.

A drive member (e.g., a gear wheel) 20 is rotatably mounted in the hole 14 of the box end 11 and includes an inner periphery 24 for driving a fastener. The drive member 20 further includes an outer periphery having a first end with an annular groove 21, a second end with a recessed portion 22, and an intermediate portion with a plurality of teeth 23. The drive member 20 is received in the hole 14 of the box end 11 with a C-clip 25 partially engaged in the annular groove 141 of the box end 11 and partially engaged in the annular groove 21 of the drive member 20 and with the recessed portion 22 of the second end of the drive member 20 abutting on the annular ledge 142 of the box end 11. Thus, the annular ledge 142 of the box end 11 prevents disengagement of the drive member 20. In an alternative embodiment, as shown in FIG. 15A, the drive member (now designated by 20') includes a drive column 26 instead of the inner periphery in the first embodiment. Thus, the wrench can be used with a socket (not shown).

A compartment 15 is defined in a peripheral wall defining the hole 14 of the box end 11 and communicated with the hole 14. A receiving hole 16 extends from a side of the box end 11 toward the other side of the box end 11 but spaced from the other side of the box end 11. The receiving hole 16 intersects with the compartment 15. Preferably, the receiving hole 16 extends in a direction perpendicular to a general plane of the compartment 15. A slot 17 is defined in the bulge portion 13 and communicated with the receiving hole 16.

A pawl 30 is slidably mounted in the compartment 15 of the box end 11 and includes a toothed first side 31 and a second side opposite to the first side 31. The second side of the pawl 30 includes a retaining groove 32 with two sides. Further, the pawl 30 includes a first abutting end 33 and a second abutting end 33 for abutting against a wall defining the compartment 15 that receives the pawl 30.

A pivotal member 50 is rotatably mounted in the receiving hole 16 and includes an end with an engaging groove 51. Further, the pivotal member 50 includes a receptacle 52 in a periphery thereof for receiving a biasing means 60 comprised of an elastic element (e.g., a spring 62) and a pressing member (e.g., a pin 61) having a blind hole 611 for receiving a portion of the spring 62. Further, the pivotal member 50 includes two grooves 53 and 54 in the periphery and located on both sides of the receptacle 52.

A switch member 40 includes a first end 41 engaged in the engaging groove 51 of the pivotal member 50 and a second end 42 outside the box end 11 of the wrench 10. It is appreciated that the switch member 40 extends through the slot 17 of the bulge portion 13 of the wrench 10, and the slot 17 is sufficiently long to allow pivotal movement of the switch member 40. As illustrated in FIG. 2, the engaging groove 51 is preferably I-shaped for securely receiving the first end 41 of the switch member 40 having a corresponding configuration. The second end 42 of the switch member 40 is wide enough to avoid painful feeling in the user's finger during switching.

Figure 3:
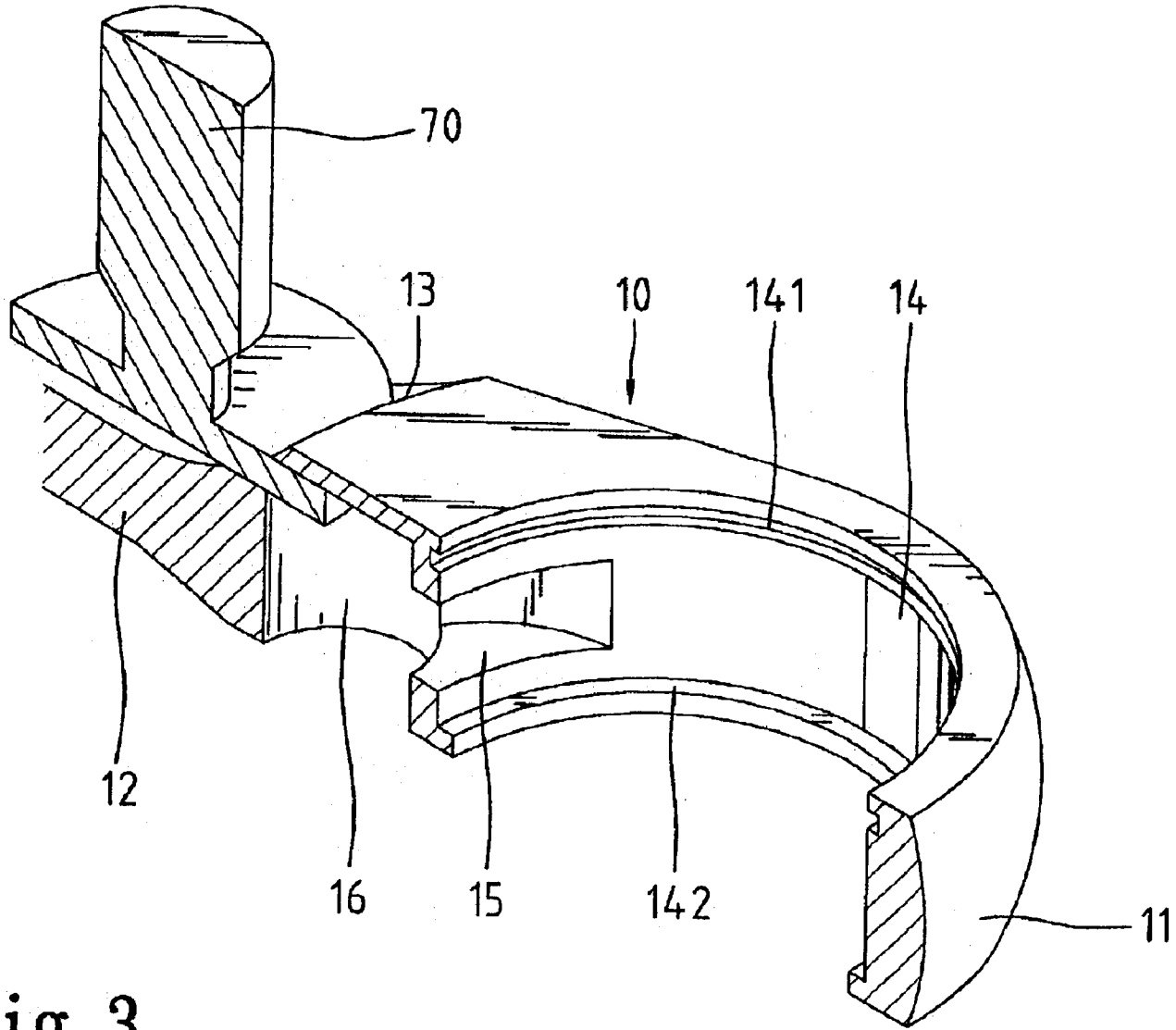
FIG. 3 is a perspective view, partly cutaway, of the wrench in FIG. 2, illustrating formation of a slot in a bulge portion of a box end of the wrench by a cutter.
Figure 4:
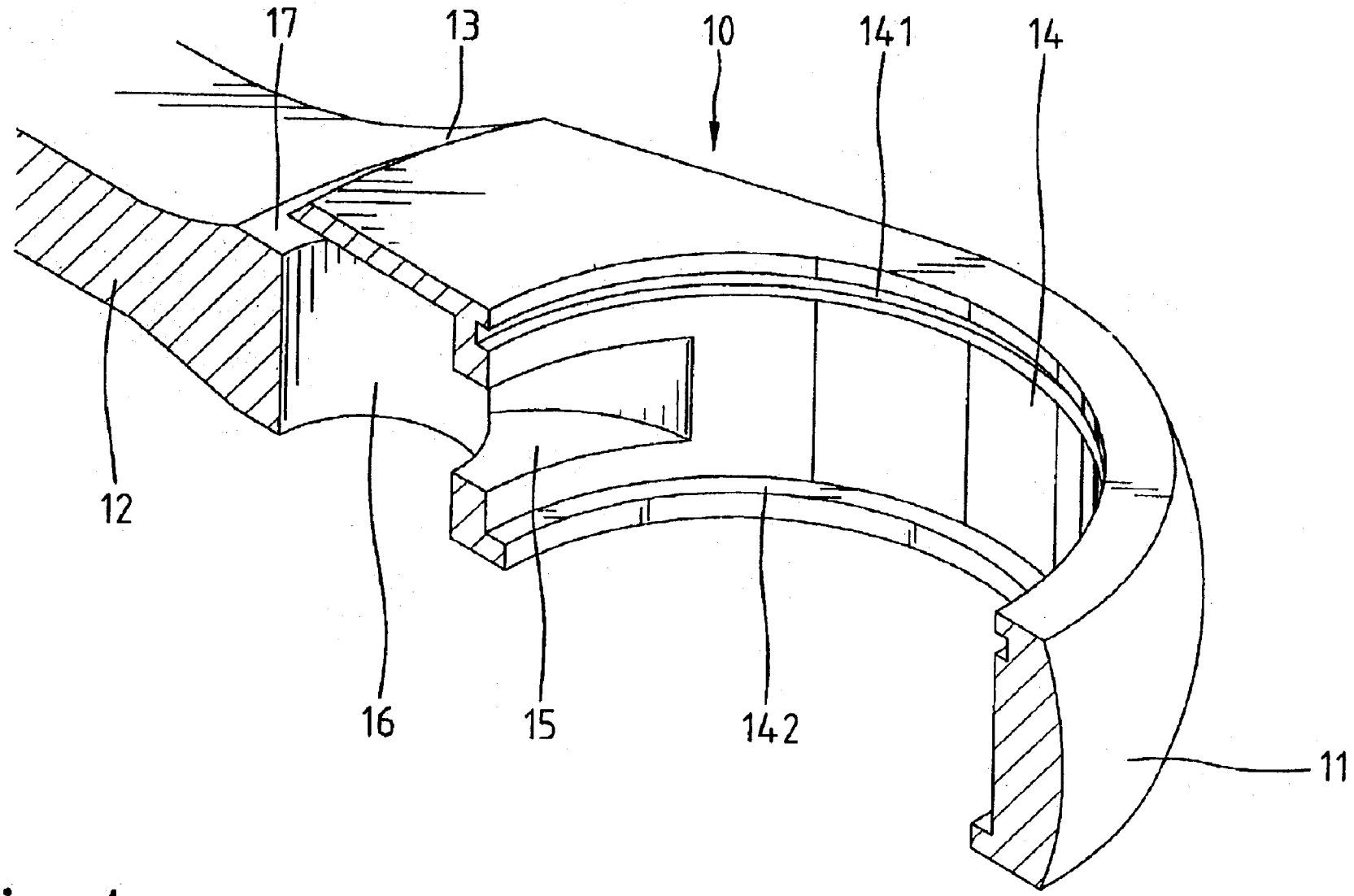
FIG. 4 is a perspective view similar to FIG. 3, wherein formation of the slot is completed.

FIG. 3 illustrates formation of the slot 17 in the bulge portion 13 of the box end 11 by means of milling by a cutter 70. As illustrated in FIG. 4, after formation, the slot 17 is communicated with an end of the receiving hole 16.

Figure 6:
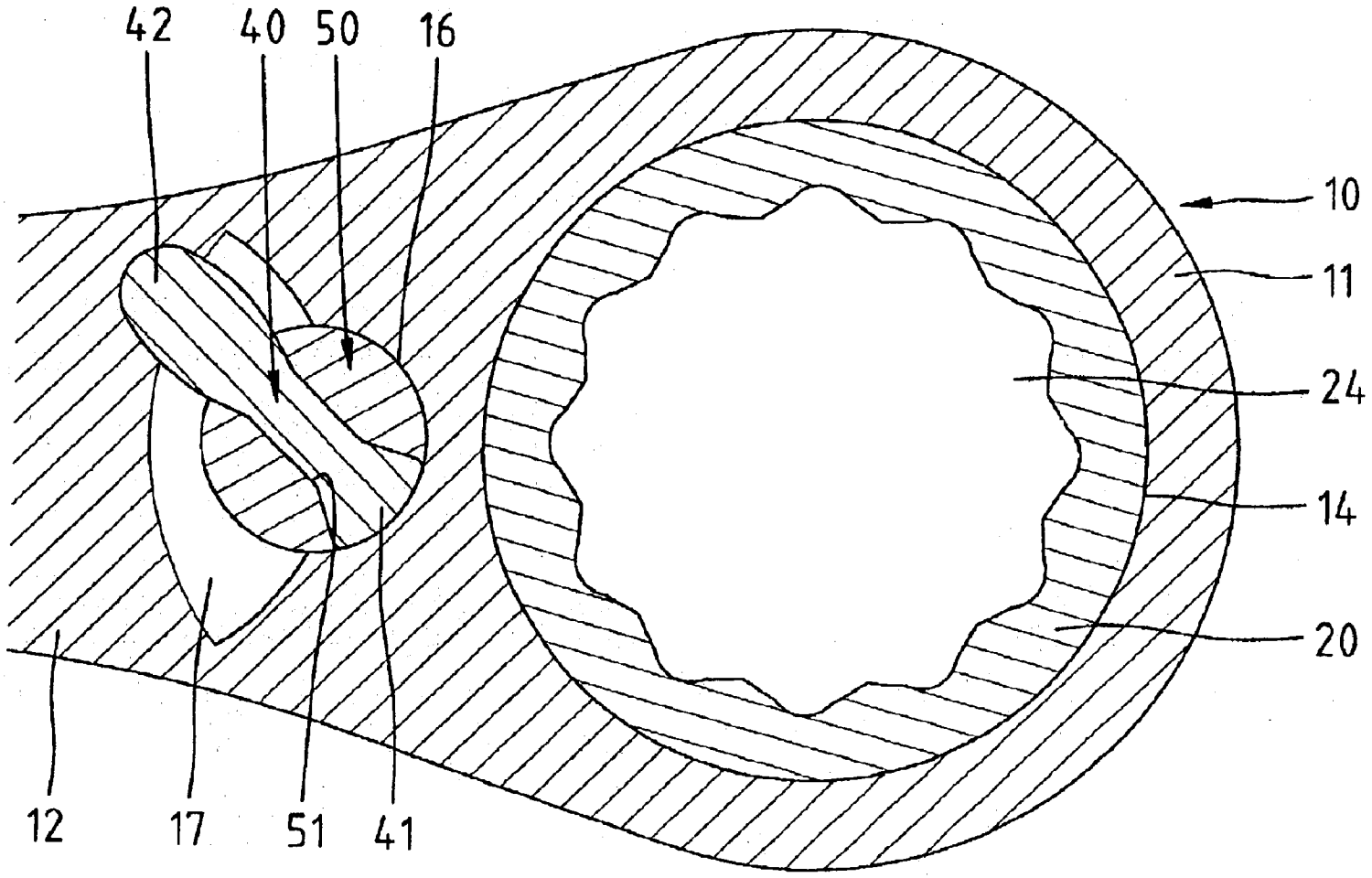
FIG. 6 is a sectional view taken along plane 6—6 in FIG. 5.
Figure 7:
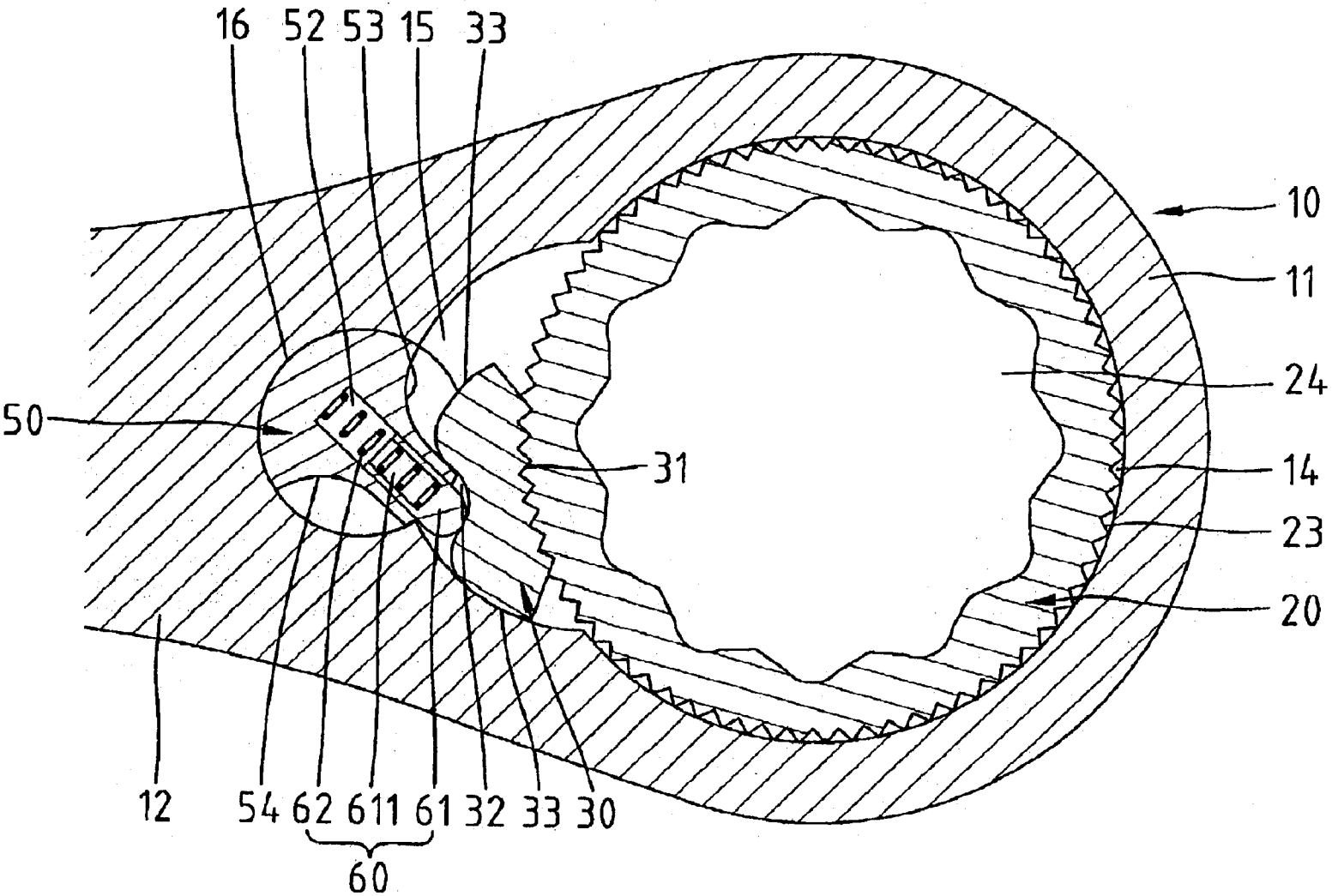
FIG. 7 is a sectional view taken along plane 7—7 in FIG. 5.

When the switch member 40 is in a position shown in FIGS. 6 and 7, the pin 61 is biased by the spring 62 to press against a side of the retaining groove 32, which, in turn, biases the pawl 30 to engage with the teeth 23 of the drive member 20 with an abutting end 33 of the pawl 30 pressing against a portion of the wall defining the compartment 15. Thus, the wrench allows ratcheting in the counterclockwise direction and allows free rotation in the clockwise direction. It is noted that a portion of the pawl 30 is received in the receiving groove 53 of the pivotal member 50, thereby preventing disengagement of the pivotal member 50 from the receiving hole 16.

Figure 8:
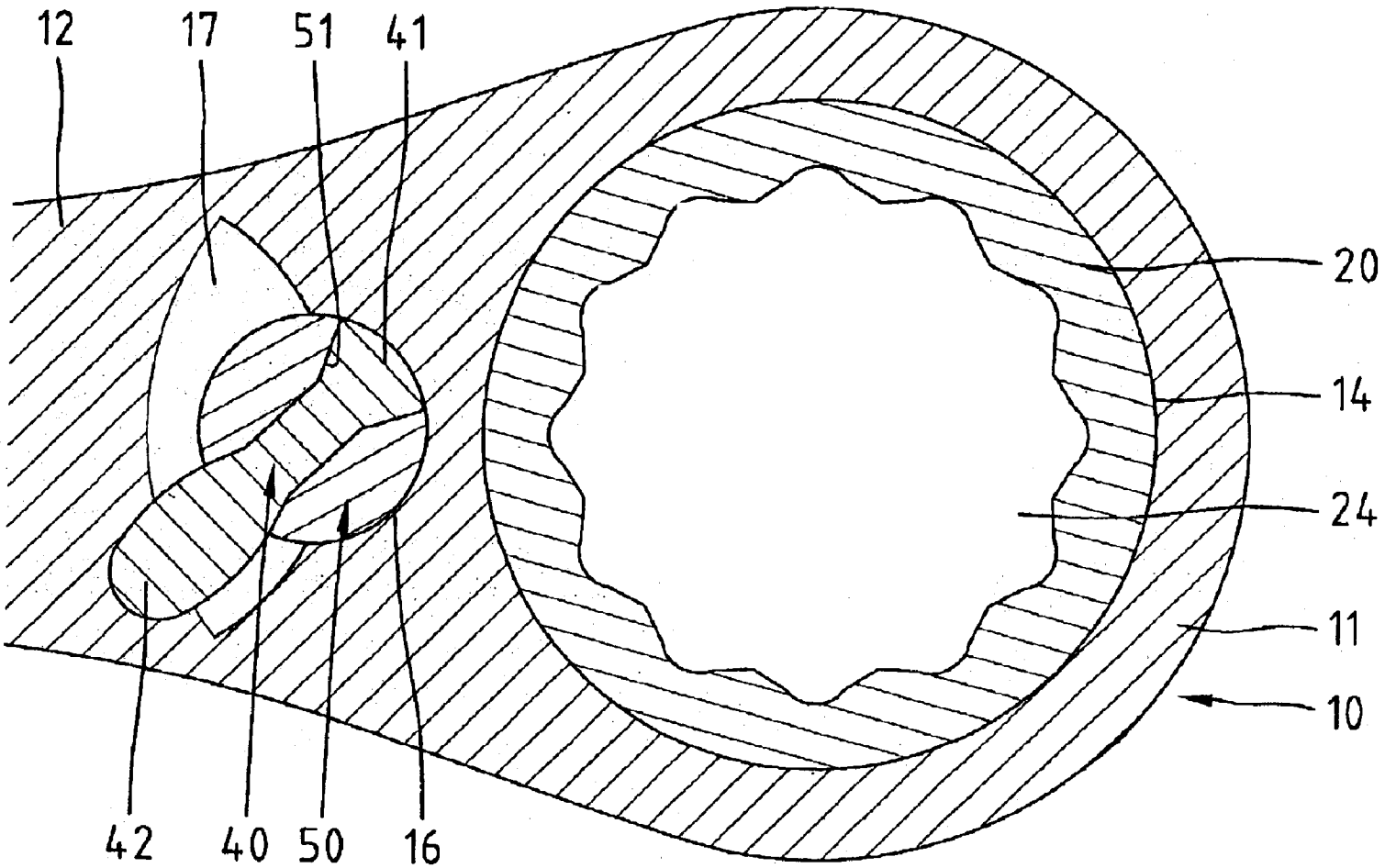
FIG. 8 is a view similar to FIG. 6, wherein a switch member of the wrench is in a position allowing ratcheting in a reverse direction.
Figure 9:
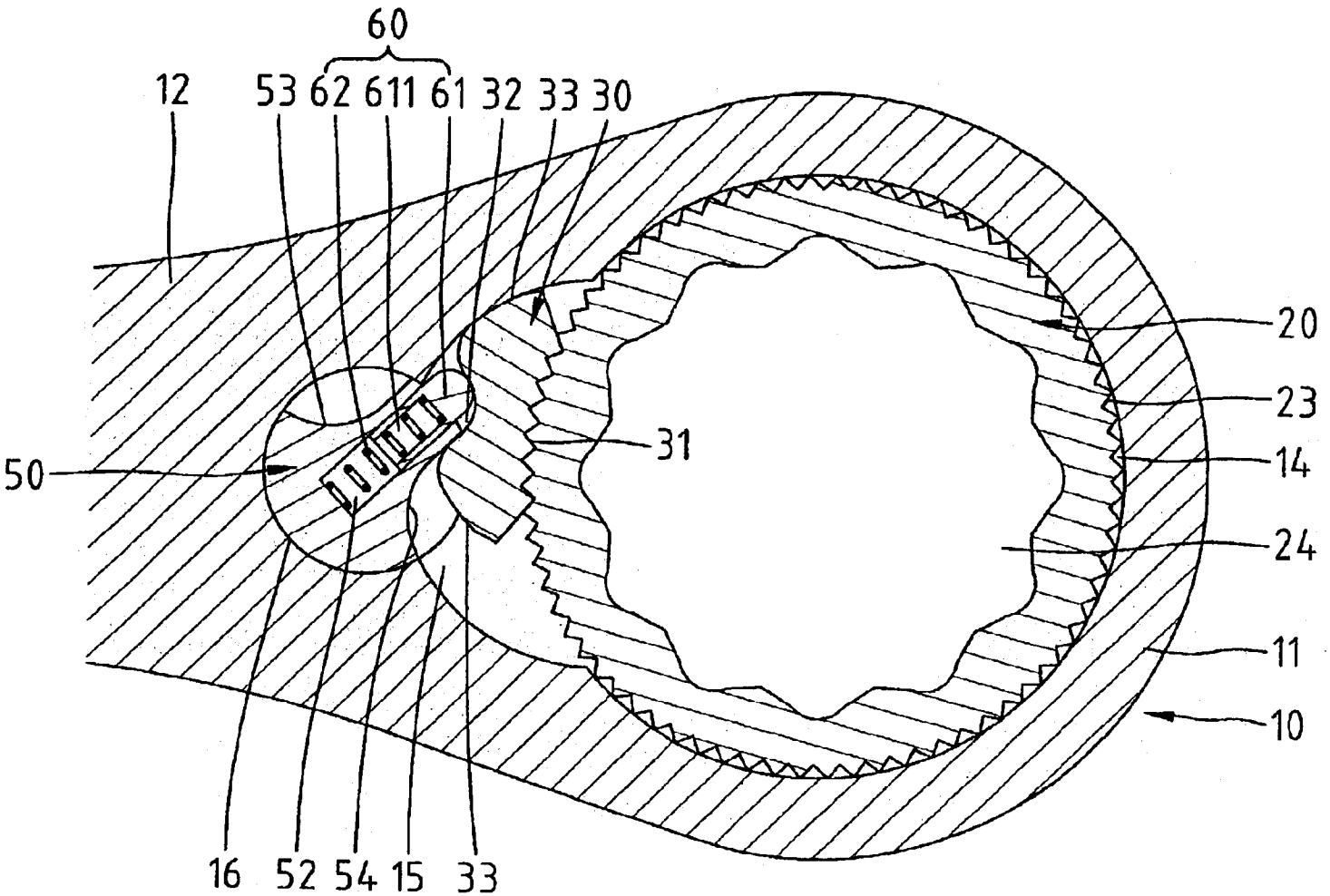
FIG. 9 is a view similar to FIG. 7, wherein the switch member of the wrench is in a position allowing ratcheting in a reverse direction.

When the switch member 40 is in a position shown in FIGS. 8 and 9, the pin 61 is biased by the spring 62 to press against the other side of the retaining groove 32, which, in turn, biases the pawl 30 to engage with the teeth 23 of the drive member 20 with the other abutting end 33 of the pawl 30 pressing against another portion of the wall defining the compartment 15. Thus, the wrench allows ratcheting in the clockwise direction and allows free rotation in the counterclockwise direction. It is noted that a portion of the pawl 30 is received in the other receiving groove 54 of the pivotal member 50, thereby preventing disengagement of the pivotal member 50 from the receiving hole 16.

In either position, alien objects, oil, or dirt are not allowed to enter the compartment 15 that receives the pawl 30, as they will be obstructed by the pivotal member 50 in the receiving hole 16. Further, the switch member 40 would not move together with the pawl 30 during operation of the wrench. The engagement between the pawl 30 and the drive member 20 is not adversely affected.

Figure 10:
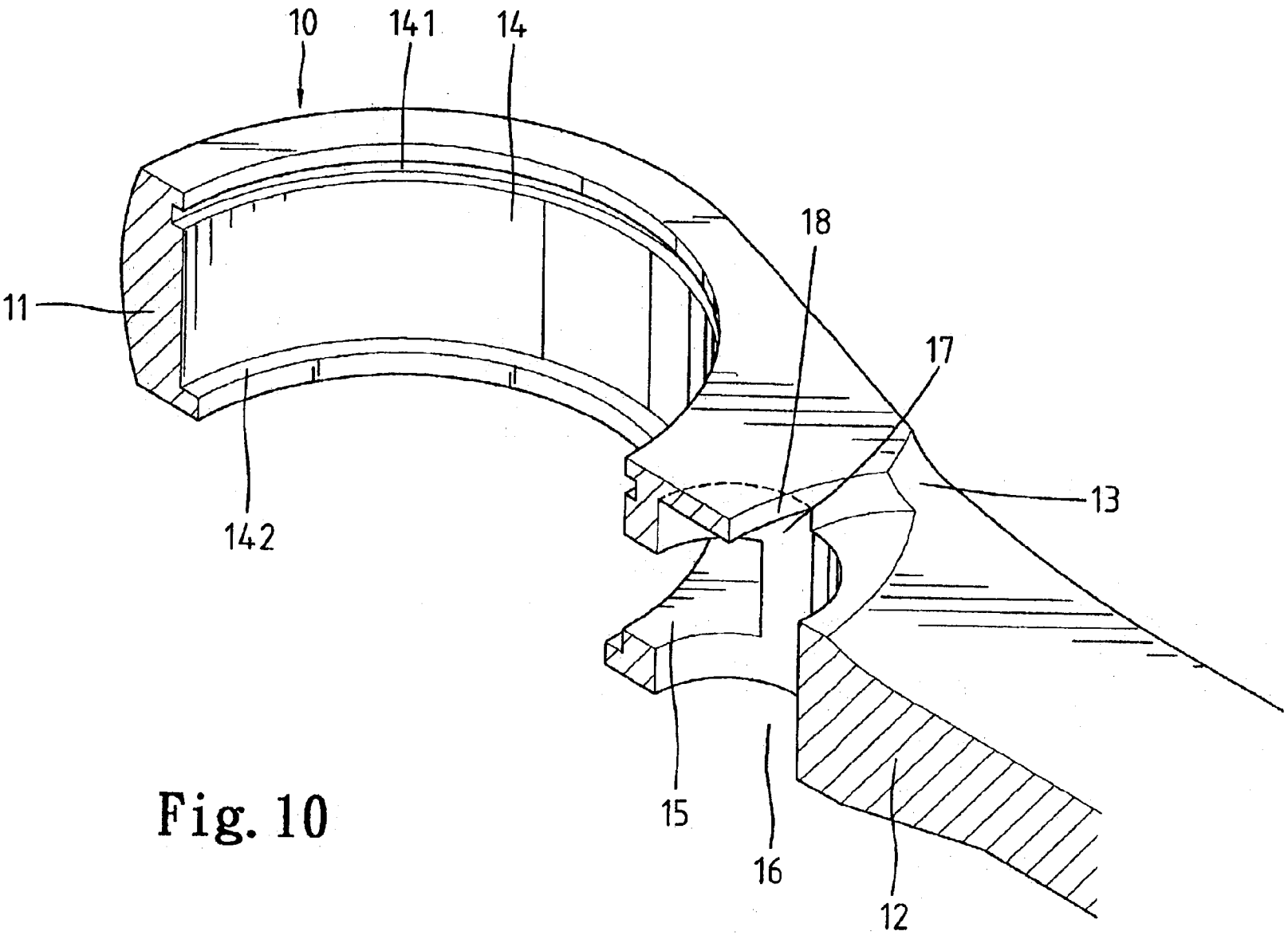
FIG. 10 is a perspective view illustrating a portion of a second embodiment of the wrench in accordance with the present invention.
Figure 11:
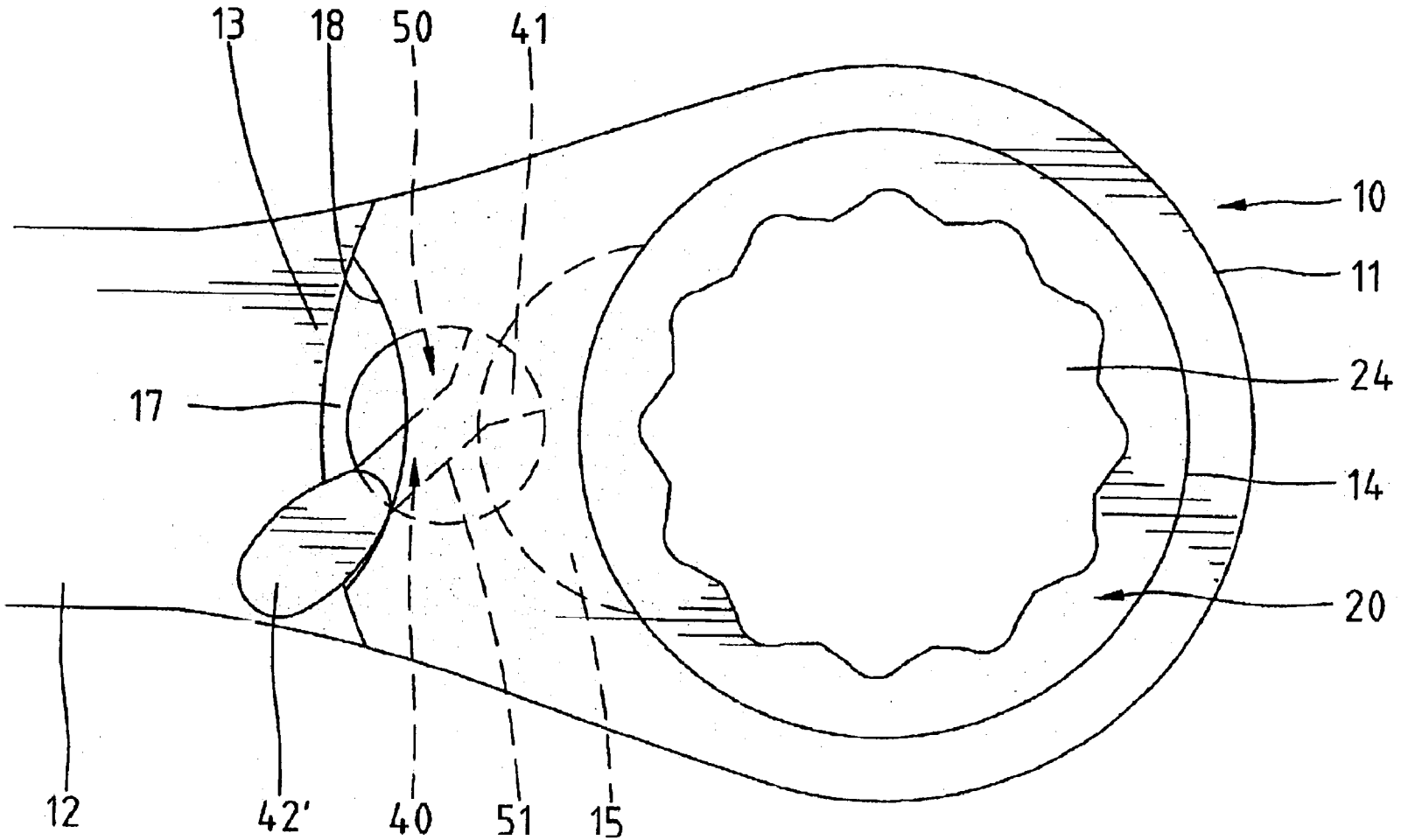
FIG. 11 is a schematic top view of the second embodiment of the wrench.
Figure 12:
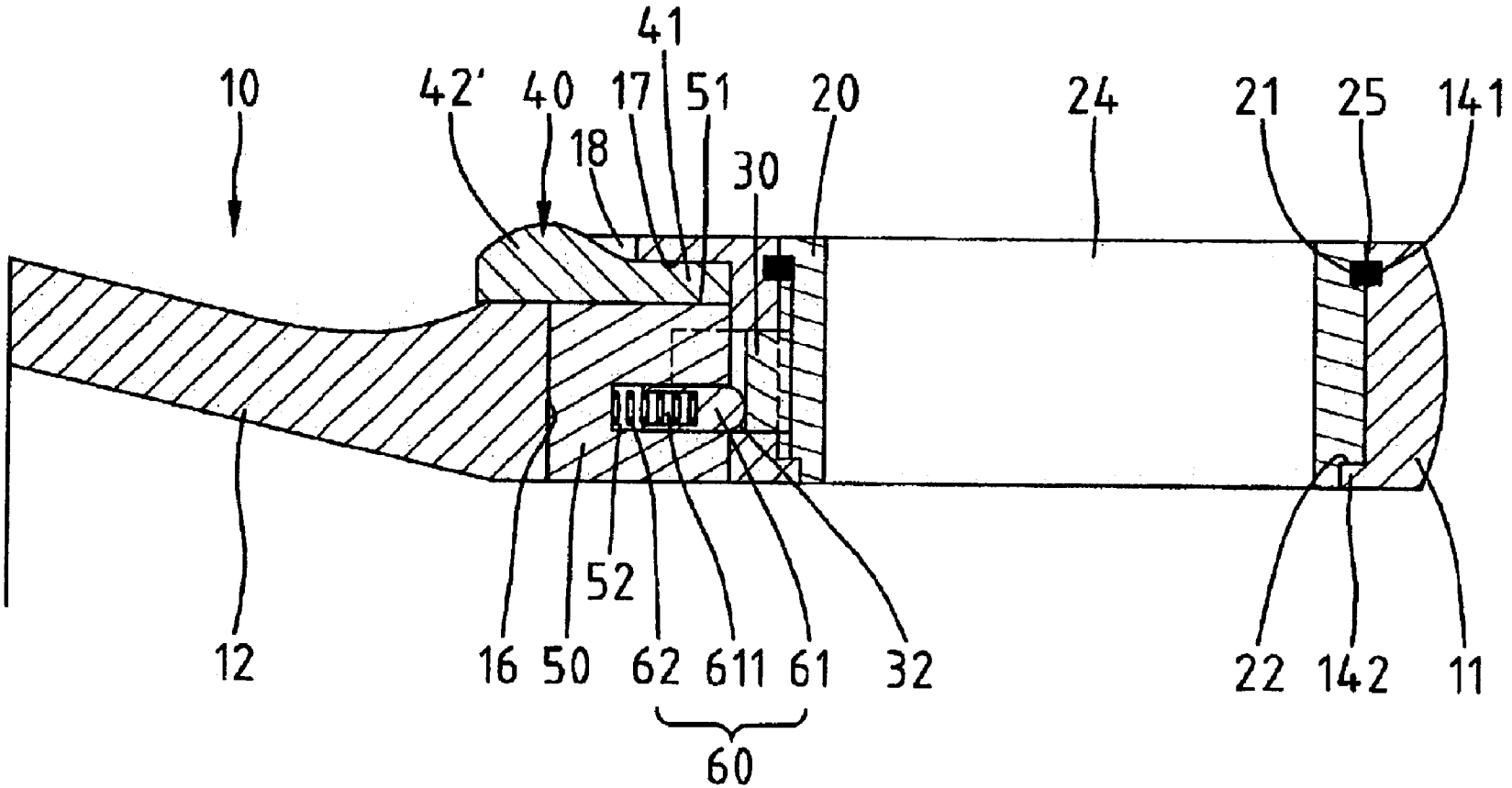
FIG. 12 is a sectional view of the wrench in FIG. 11.

FIGS. 10 through 12 illustrate a second embodiment of the invention, wherein the bulge portion 13 of the box end 11 includes an arcuate portion 18 such that a portion of the slot 17 is exposed, best shown in FIG. 11. Thus, the switch member 40 may have a shorter length, and the second end (now designated by 42') of the switch member 40 may be wider to further avoid painful feeling in the user's finger during switching.

Figure 13:
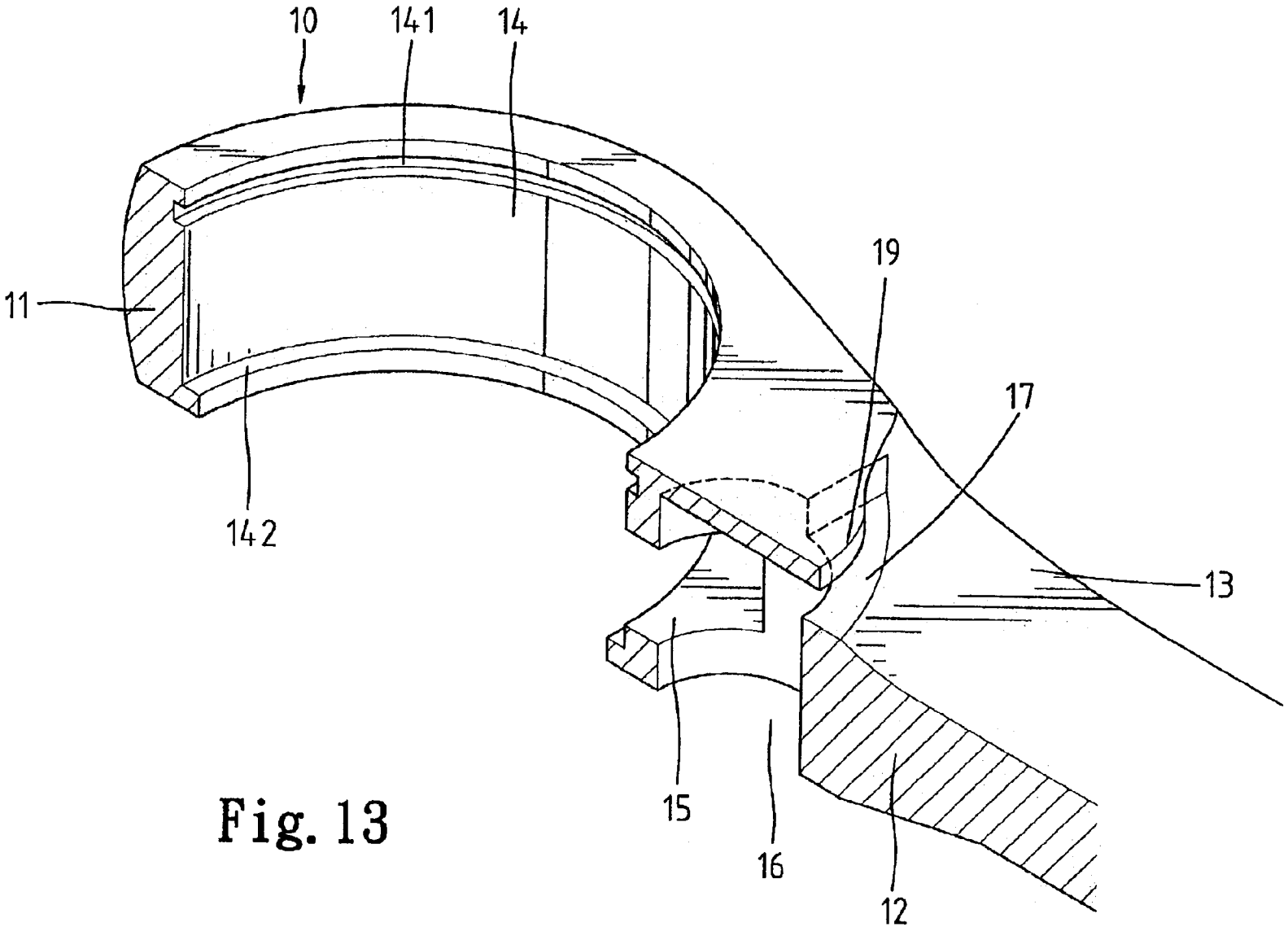
FIG. 13 is perspective view illustrating a portion of a third embodiment of the wrench in accordance with the present invention.
Figure 14:
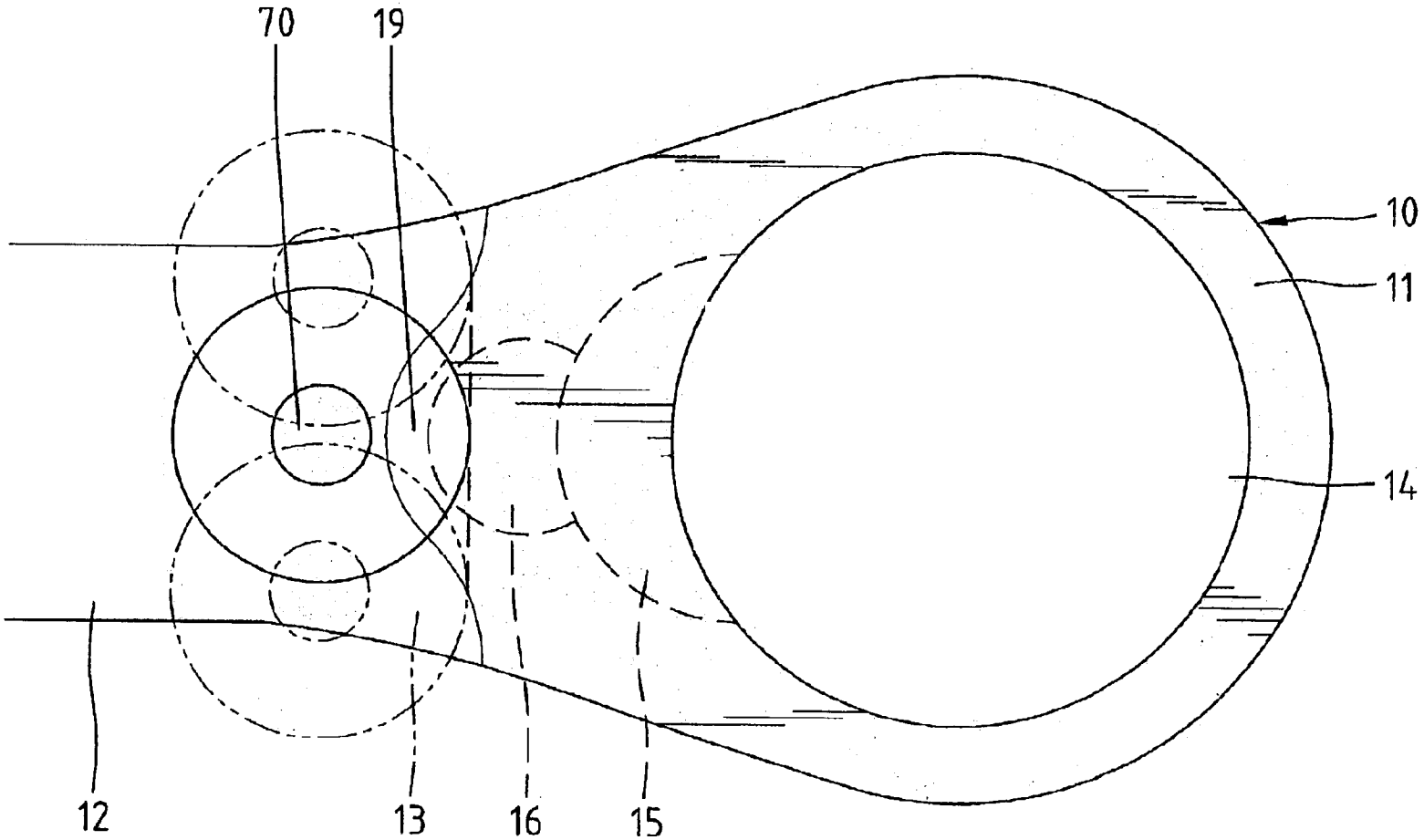
FIG. 14 is a schematic top view illustrating formation of a slot in a bulge portion of the box end of the wrench in FIG. 13.
Figure 15:
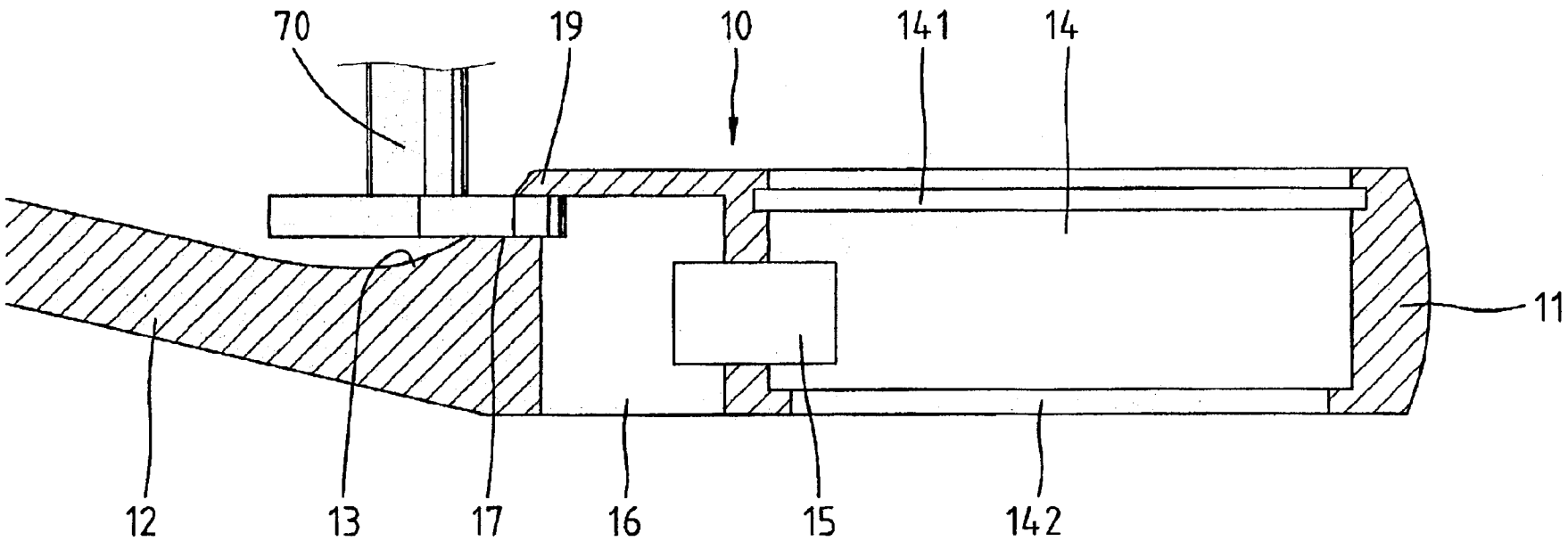
FIG. 15 is a sectional view illustrating formation of a slot in a bulge portion of the box end of the wrench in FIG. 13.
Figure 15A:
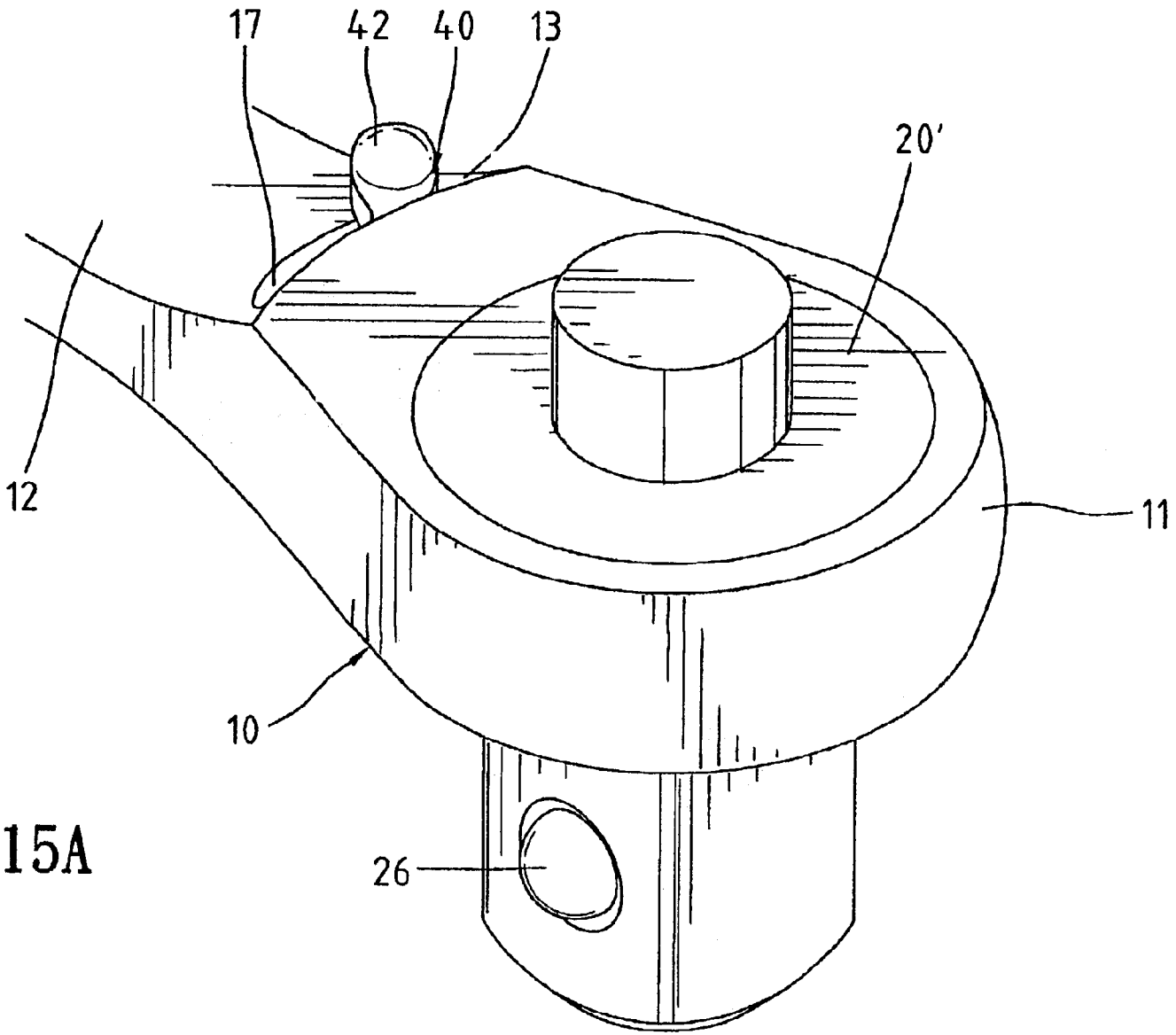
FIG. 15A is a perspective view illustrating a modified embodiment of the wrench in accordance with the present invention.
Figure 16:
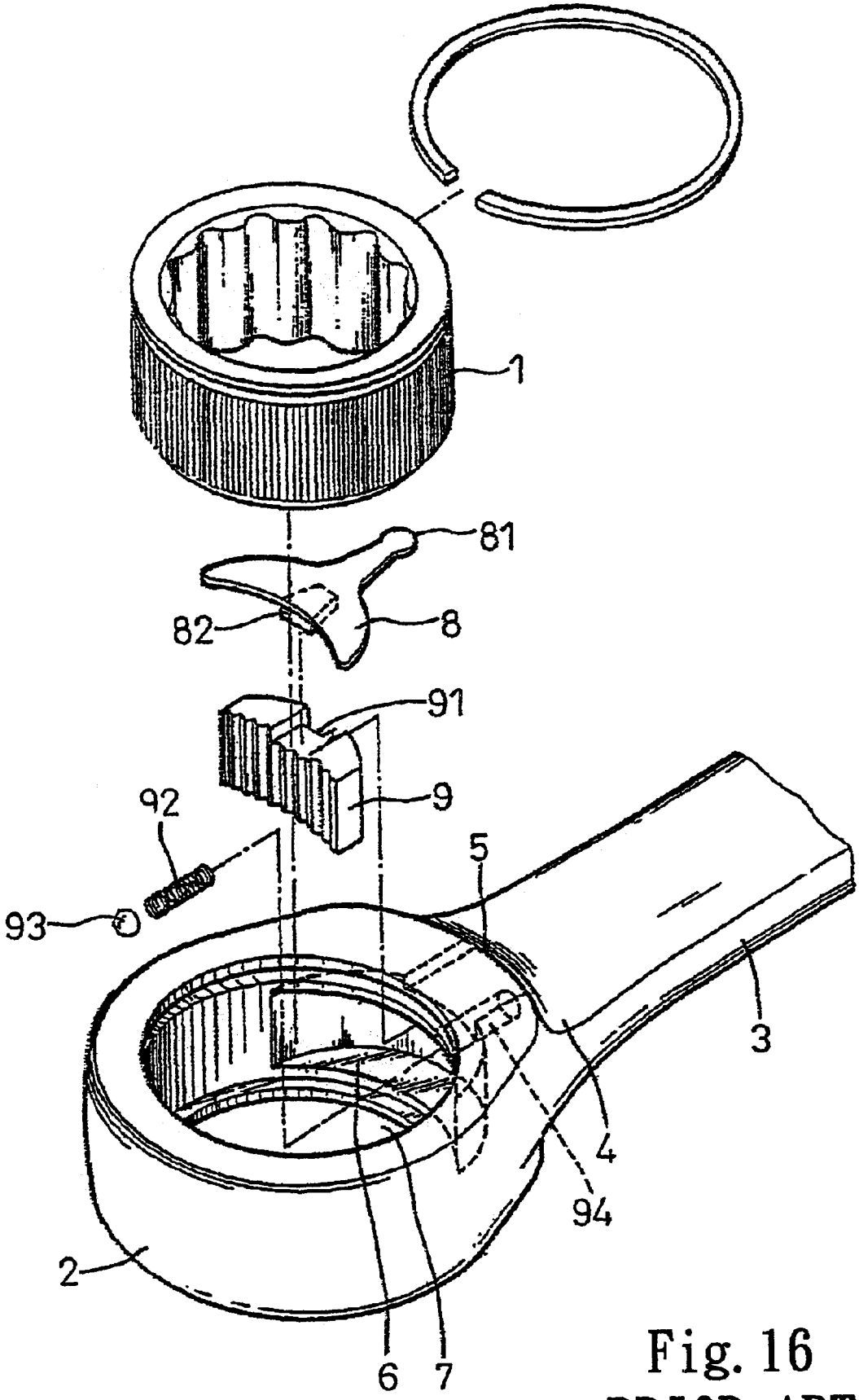
Fig. 16 PRIOR ART
FIG. 16 is an exploded perspective view of a conventional reversible ratchet type wrench.
Figure 17:
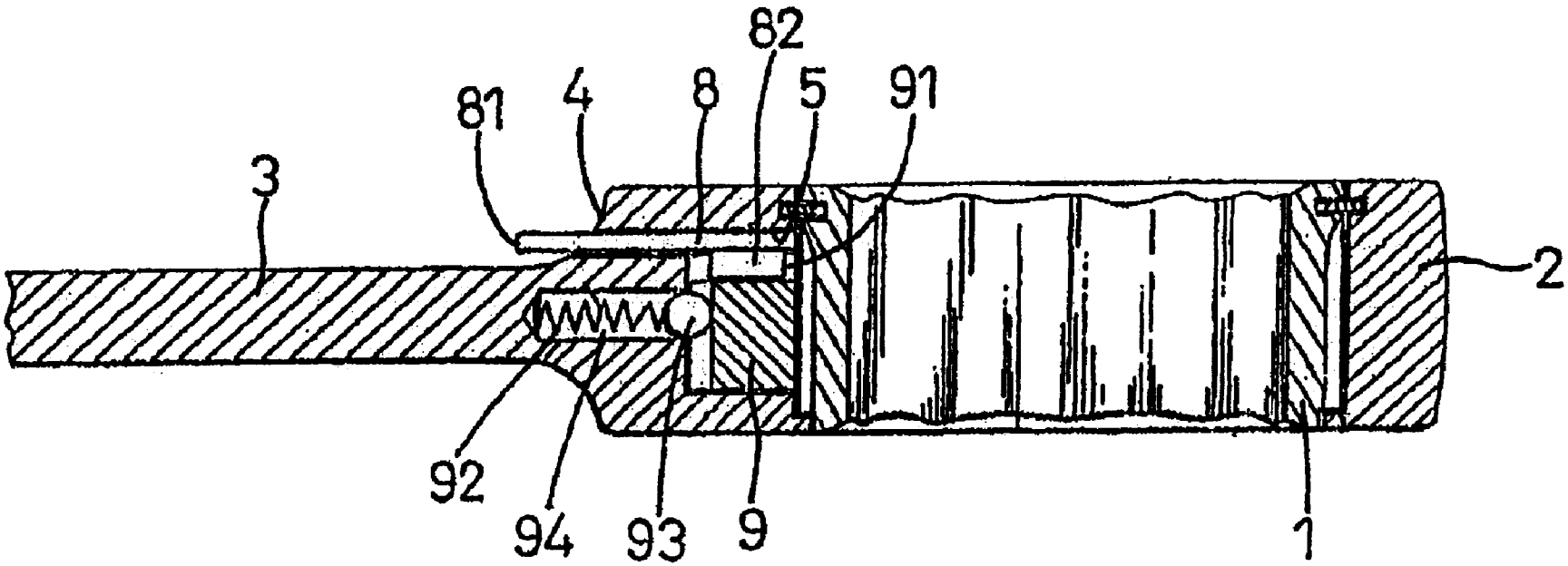
Fig. 17 PRIOR ART
FIG. 17 is a sectional view of the reversible ratchet type wrench in FIG. 16.

FIGS. 13 through 15 illustrate a third embodiment of the invention, wherein the bulge portion 13 includes an end edge 19 extending away from the receiving hole 16 to a position beyond a peripheral wall defining the receiving hole 16, best shown in FIG. 15. FIGS. 14 and 15 illustrate formation of the slot 17 by means of milling by a cutter 70 that moves along a direction perpendicular to a longitudinal axis of the handle 12. Preferably, the end edge 19 is curved, best shown in FIG. 14. The end edge 19 may shield most parts of the switch member 40 except the second end 42 of the switch member 40. Thus, the risk of inadvertent impingement to the switch member 40 is lowered.

According to the above description, it is noted that oil, dirt, ashes, or larger alien objects could not enter the compartment 15 through the slot 17. Formation of the slot 17 is easy. Further, the switch member 40 would not move together with the pawl 30 during operation of the wrench. The engagement between the pawl 30 and the drive member 20 is not adversely affected.

Although the invention has been explained in relation to its preferred embodiment, it is to be understood that many other possible modifications and variations can be made without departing from the scope of the invention as hereinafter claimed.

What is claimed is:

1. A reversible ratchet type wrench comprising:

a handle;

a box end extending from an end of the handle and having a first side and a second side opposite to the first side, a hole being defined in the box end, a compartment being defined in a peripheral wall defining the hole of the box end and communicated with the hole, a receiving hole having an axis and extending from the first side of the box end toward the second side of the box end but spaced from the second side of the box end, with the receiving hole having an upper end and a lower end, with the lower end opening on the first side of the box end, with the receiving hole intersecting the compartment;

a bulge portion formed in a conjunctive area between the handle and the box end on the second side of the box end, with the bulge portion extending over the receiving hole and defining a terminal wall of the upper end of the receiving hole;

a slot being defined in the bulge portion, with the slot extending radially from the receiving hole and communicated with the upper end of the receiving hole, with the slot located axially intermediate the first side of the box end and the terminal wall;

a drive member rotatably mounted in the hole of the box end and including a plurality of teeth on an outer periphery thereof;

a pawl slidably mounted in the compartment of the box end and including a toothed side;

a pivotal member rotatably mounted in the receiving hole of the box end, with the pivotal member having a top end and a bottom end, with the lower end of the receiving hole receiving the pivotal member on the first side of the box end, with the terminal wall of the upper end of the receiving hole being closed to removal of the pivotal member;

a switch member extending radially through the slot of the bulge portion, with the switch member including a first end sandwiched between the top end of the pivotal member and the terminal wall and securely engaged with the pivotal member to move therewith and a second end outside the box end for manual operation between two positions corresponding to two ratcheting directions of the wrench;

a pressing member mounted between the pawl and the pivotal member; and an elastic element for biasing the pressing member against the pawl.

2. The reversible ratchet type wrench as claimed in claim 1, wherein the outer periphery of the drive member includes an end with an annular groove, with the peripheral wall defining the hole of the box end including an annular groove in an end thereof, with the reversible ratchet type wrench further including a C-clip partially received in the annular groove of the drive member and partially received in the annular groove of the peripheral wall defining the hole of the box end.

3. The reversible ratchet type wrench as claimed in claim 1, wherein the outer periphery of the drive member includes an end with a recessed portion, the peripheral wall defining the hole of the box end including an annular ledge on an end thereof, the recessed portion of the drive member abutting on the annular ledge of the box end, thereby preventing disengagement of the drive member.

4. The reversible ratchet type wrench as claimed in claim 2, wherein the outer periphery of the drive member includes another end with a recessed portion, the peripheral wall defining the hole of the box end including an annular ledge on another end thereof, the recessed portion of the drive member abutting on the annular ledge of the box end, thereby preventing disengagement of the drive member.

5. The reversible ratchet type wrench as claimed in claim 1, wherein the slot of the bulge portion is communicated with the upper end of the receiving hole, with an upper wall of the slot being planar with the terminal wall of the upper end of the receiving hole, with the terminal wall defining a blind end of the receiving hole of the box end.

6. The reversible ratchet type wrench as claimed in claim 1, wherein the pivotal member includes an engaging groove on the top end thereof for securely receiving the first end of the switch member.

7. The reversible ratchet type wrench as claimed in claim 6, wherein the engaging groove of the pivotal member is configured corresponding to the first end of the switch member, with the engaging groove flaring outwards at two opposite ends and being substantially I-shaped, with the switch member engaged with the top end of the pivotal member defining a planar surface terminal the pivotal member and perpendicular the axis of the receiving hole, with the planar surface corresponding and abutting the terminal wall of the upper end of the receiving hole.

8. The reversible ratchet type wrench as claimed in claim 1, wherein the pivotal member includes a receptacle in an outer periphery thereof for receiving the elastic element and the pressing member.

9. The reversible ratchet type wrench as claimed in claim 6, wherein the pivotal member includes a receptacle in an outer periphery thereof for receiving the elastic element and the pressing member.

10. The reversible ratchet type wrench as claimed in claim 8, wherein the pressing member includes a blind hole in an end thereof for receiving an end of the elastic element.

11. The reversible ratchet type wrench as claimed in claim 8, wherein the pivotal member further includes two grooves located on the outer periphery thereof, with the receptacle being intermediate the two grooves, with a portion of the pawl being selectively received in one of the two grooves, thereby preventing disengagement of the pivotal member from the receiving hole.

12. The reversible ratchet type wrench as claimed in claim 9, wherein the pressing member includes a blind hole in an end thereof for receiving an end of the elastic element.

13. The reversible ratchet type wrench as claimed in claim 1, wherein the pawl includes a second side opposite to the toothed side, a retaining groove being defined in the second side of the pawl and including two sides, the pressing member being biased by the elastic element to selectively press against one of the two sides of the retaining groove.

14. The reversible ratchet type wrench as claimed in claim 13, wherein the pawl further includes two abutting ends for selectively abutting against a wall defining the compartment.

15. The reversible ratchet type wrench as claimed in claim 1, wherein the bulge portion includes an arcuate portion, with the arcuate portion defining an upper edge of the slot leaving a portion of the slot exposed.

16. The reversible ratchet type wrench as claimed in claim 1, wherein the bulge portion includes an end edge intermediate the slot and the second side and extending away from and perpendicular the axis of the receiving hole to a position beyond a peripheral wall defining the receiving hole and toward the handle, with the end edge defining an upper edge of the opening of the slot.

17. A reversible ratchet type wrench handle comprising:

a box end extending from an end of the handle and having a first side and a second side opposite to the first side, a hole being defined in the box end, a compartment being defined in a peripheral wall defining the hole of the box end, with the compartment spaced from the first and second sides of the box end and communicated with the hole, a receiving hole having an axis and extending from the first side of the box end toward the second side of the box end but spaced from the second side of the box end, with the receiving hole having an upper end and a lower end, with the lower end opening on the first side of the box end, with the receiving hole being radially spaced from the hole and intersecting the compartment; and a bulge portion formed in a conjunctive area between the handle and the box end on the second side of the box end, with the bulge portion extending over the receiving hole and defining a terminal wall of the upper end of the receiving hole, a slot being defined in the bulge portion, with the slot extending radially from the receiving hole and communicated with the upper end of the receiving hole, with the slot located intermediate the first side of the box end and the terminal wall.

18. The reversible ratchet type wrench handle as claimed in claim 17, wherein the slot of the bulge portion is communicated with the upper end of the receiving hole, with an upper wall of the slot being planar with the terminal wall of the upper end of the receiving hole, with the terminal wall defining a blind end of the receiving hole of the box end.

19. The reversible ratchet type wrench handle as claimed in claim 17, wherein the bulge portion includes an arcuate portion, with the arcuate portion defining an upper edge of the slot leaving a portion of the slot exposed.

20. The reversible ratchet type wrench handle as claimed in claim 17, wherein the bulge portion includes an end edge intermediate the slot and the second side and extending away from and perpendicular the axis of the receiving hole to a position beyond a peripheral wall defining the receiving hole and toward the handle, with the end edge defining an upper edge of the opening of the slot.

* * * * *